United States Patent [19]

Driskell

[11] 4,079,811

[45] Mar. 21, 1978

[54] CABINET TYPE FIRE ESCAPE

[75] Inventor: Kay E. Driskell, Cape Girardeau, Mo.

[73] Assignee: The Raymond Lee Organization, Inc., New York, N.Y.

[21] Appl. No.: 807,786

[22] Filed: Jun. 20, 1977

[51] Int. Cl.[2] ..... E06C 9/14

[52] U.S. Cl. ..... 182/35; 182/70

[58] Field of Search ..... 182/35, 28, 70, 71, 182/72, 73, 74, 75

[56] References Cited

U.S. PATENT DOCUMENTS

| | | | |
|---|---|---|---|
| 384,292 | 6/1888 | Smith | 182/73 |
| 616,318 | 12/1898 | Hanskey | 182/35 |
| 632,226 | 8/1899 | Menges | 182/70 |
| 866,256 | 9/1907 | Calnan et al. | 182/73 |

*Primary Examiner*—Reinaldo P. Machado

*Attorney, Agent, or Firm*—Howard I. Podell

[57] ABSTRACT

An enclosure which serves as a storage means for a fire escape ladder, made from a rope-like flexible material, is given a decorative appearance and is provided with a set of drawers for storing valuables. By its weight the enclosure itself, once thrown out of a window, serves to unwind and place in position the fire escape ladder.

3 Claims, 3 Drawing Figures

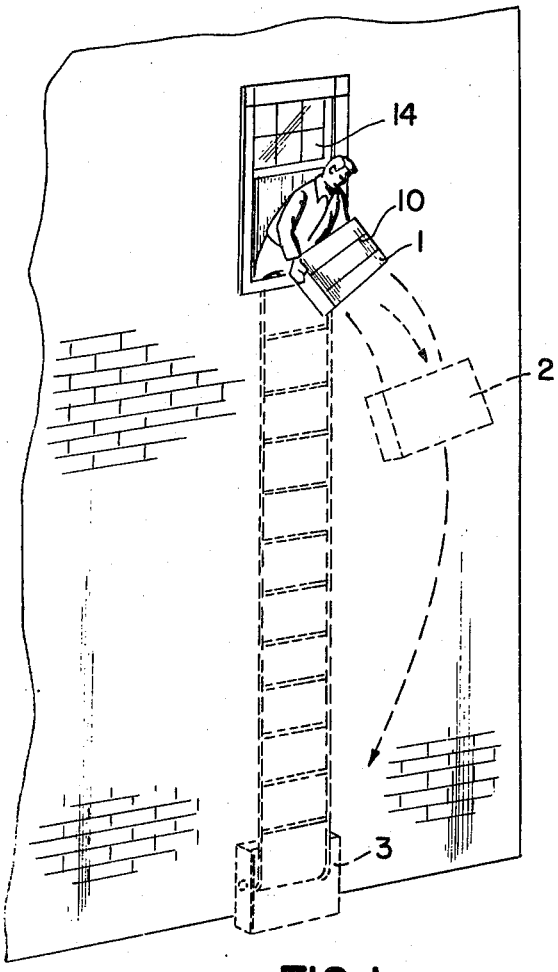
FIG. 1
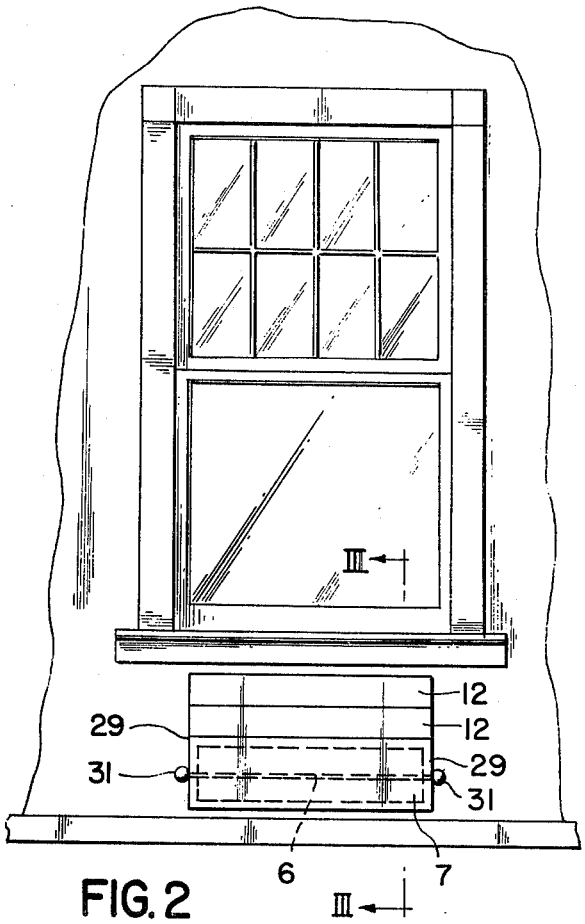
FIG. 2
FIG. 3
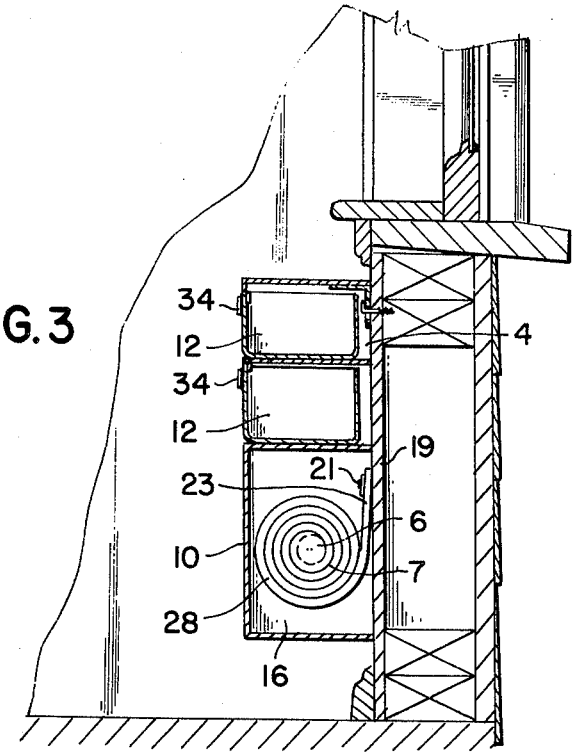

CABINET TYPE FIRE ESCAPE

SUMMARY OF THE INVENTION:

The objective of the invention being to provide a life saving device, namely a fire escape ladder always ready to serve people in time of danger, the novelty of it is centered on combining the decorative appeal of its enclosure, placed usually under a window sill, with the useful utilization of the weight of this enclosure for unwinding of the fire ladder in an expedient and fast manner, and with the ability to remove to safety the set of drawers forming part of this enclosure. The contents of the drawers may advantageously and usefully include valuable documents and belongings. Other important elements of the invention are the features of making the ladder from a flexible rope-like material behaving like a rope but not flammable and not subject to rot and decay, and the provision of securing the contents of the drawers with locks, preferably using the same key.

BRIEF DESCRIPTION OF THE DRAWINGS:

The objects and features of the invention may be understood with reference to the following detailed description of an illustrative embodiment of the invention, taken together with the accompanying drawings in which:

FIG. 1 is a perspective view that shows the use of the invented cabinet type fire escape;

FIG. 2 is an elevation view which indicates the position of the cabinet type fire escape when not in use, stored under a window; and FIG. 3 is a section along III—III of FIG. 2.

DESCRIPTION OF THE PREFERRED EMBODIMENT:

Turning now descriptively to the drawings, in which similar reference characters denote similar elements throughout the several views, FIG. 1 shows the invention in its intended use, helps to explain how different elements of this combination cooperate together, creating a new and useful device. The cabinet type fire escape is tilted out of the window when necessary in time of danger. This single operation accomplishes all the desired results. The weight of the cabinet 10 unwinds and pulls down the fire escape flexible ladder, while simultaneously, the contents of the drawers 12 of the cabinet 10 are removed from the fire endangered area without loss of time, which in a situation of this kind is of vital importance.

The set of drawers 12 slidably fitted in the cabinet recesses 4 and 5, as shown in FIGS. 2 and 3, would naturally be an excellent place to store valuables and documents. A lock 34 is fixed to each drawer to latch each of the set of drawers in the closed position in ordinary circumstances; and to make the appearance of the invention inobtrusive and even attractive. The cabinet itself may be manufactured decoratively and in pleasing proportions, the only requirement being that it must have enough clearance to be passed through a given size window opening 14.

As shown on FIG. 3, the cabinet is loosely hung from a hook on a wall and encloses in its lower compartment 16 a coiled fire escape ladder 7 made from rope-like flexible material which has preferably noncombustible properties and is not subject to rot and decay.

One end section 23 of ladder 7 is attached by fastener 21 to wall 19 through the open rear face of lower compartment 16, with the remainder of the ladder formed as a coil 29 about a spool rod 16 that is rotatably supported by opposed side walls 29 of the cabinet. Rod assembly 6 is able to revolve in its side wall supports; at the same time, its protruding ends which extend externally beyond the side walls 29 may serve as handles to use for lifting and tilting the cabinet; these protruding ends may be adorned additionally with knobs 31 decoratively designed. Referring again to FIG. 1, in position 3, after its intended use, the cabinet may be cut from the rope and carried away, with rod knobs 31 serving for the convenience of carrying the set of drawers, and the cabinet.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A cabinet fitted with a first compartment in which a flexible ladder is coiled about a shaft rotatably fitted to opposed side walls of the cabinet, with a slidable drawer mounted in a second compartment of the cabinet, said first compartment formed with an open rear side to permit an end of the ladder to be fixed to a wall adjacent a window opening, with said cabinet of a size to freely pass through such a window opening.

2. The combination as recited in claim 1 in which the shaft extends beyond each side of the cabinet, with the exterior sections of the shaft serving as handles.

3. The combination as recited in claim 2 in which a knob is externally fixed to each exterior section of the shaft.

* * * * *